US007771020B2

(12) United States Patent
Miyazaki et al.

(10) Patent No.: US 7,771,020 B2
(45) Date of Patent: Aug. 10, 2010

(54) INK JET RECORDING HEAD

(75) Inventors: Kyota Miyazaki, Tama (JP); Toshiaki Hirosawa, Hiratsuka (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 607 days.

(21) Appl. No.: 11/781,866

(22) Filed: Jul. 23, 2007

(65) Prior Publication Data

US 2008/0024542 A1 Jan. 31, 2008

(30) Foreign Application Priority Data

Jul. 25, 2006 (JP) ..... 2006-202328

(51) Int. Cl.
*B41J 2/16* (2006.01)

(52) U.S. Cl. ..... 347/50

(58) Field of Classification Search ..... 347/50, 347/56–59, 61–63, 65, 67, 40, 44, 47, 49, 347/20; 29/890.1
See application file for complete search history.

(56) References Cited

U.S. PATENT DOCUMENTS 6,609,782 B2 * 8/2003 Mori ..... 347/50
7,152,957 B2 * 12/2006 Mori ..... 347/50
7,677,700 B2 * 3/2010 Tsukuda ..... 347/50

* cited by examiner

*Primary Examiner*—K. Feggins
(74) *Attorney, Agent, or Firm*—Canon USA Inc IP Div

(57) ABSTRACT

An ink jet recording head includes a recording element substrate having an array of discharge ports and a side surface extending along an array direction of the discharge ports, and an opposite surface facing the side surface. A minimum distance is provided between the opposite surface and the side surface at least at a center portion of the side surface. Also, a distance greater than the minimum distance is provided between the opposite surface and the side surface at an end portion of the side surface in the array direction.

9 Claims, 12 Drawing Sheets

INK JET RECORDING HEAD

BACKGROUND OF THE INVENTION

1. Field of the Invention

The present invention relates to ink jet recording heads used for ink jet recording apparatuses.

2. Description of the Related Art

An example of typical recording apparatuses is an ink jet recording apparatus that performs recording by discharging ink to a recording medium.

Such an ink jet recording apparatus generally includes a recording head provided with discharge ports for discharging ink. To discharge ink, a piezoelectric element or the like may be used for discharging ink, or an electrothermal transducer such as a heating resistor may be used for heating and discharging ink by an action of film boiling.

FIG. 13 is a perspective view showing a recording element substrate 1100 of a recording head provided with an electrothermal transducer. The recording element substrate 1100 is embedded in a recording head 1001. FIG. 14 is a cross-sectional view taken along a line XIV-XIV shown in FIG. 13. FIG. 15 is a cross-sectional view taken along a line XV-XV shown in FIG. 13. For convenience of description, a sealant for sealing the periphery of the recording element substrate 1100 is not illustrated in FIG. 13. In this example shown in the drawings, the recording head 1001 includes a first plate 1200, the recording element substrate 1100, a second plate 1400, and an orifice plate 1111. The first plate 1200 has an ink supply path 1202 for supplying ink to the recording element substrate 1100. The recording element substrate 1100 is supported on the first plate 1200 and fixed thereto such that the ink supply path 1202 communicates with an ink supply port 1102 of the recording element substrate 1100. The second plate 1400 has an opening for surrounding the recording element substrate 1100 and is supported on the first plate 1200, to fix a wiring substrate 1300. The orifice plate 1111 has discharge ports, and is fixed to the recording element substrate 1100 such that the discharge ports communicate with the ink supply port 1102 of the recording element substrate 1100. With such a recording head, the periphery of the recording element substrate 1100 is sealed with a sealant. For example, an end of the recording element substrate 1100 without protection treatment is sealed with a first sealant 1307. This prevents the end from being exposed to ink, thereby preventing the end from being corroded by the ink. In addition, as shown in FIG. 15, lead terminals 1302 that connect the wiring substrate 1300 and bumps 1105 provided on the recording element substrate 1100 are covered with a second sealant 1308. Accordingly, the lead terminals 1302 may be prevented from being corroded by ink, and lead wires may be prevented from being disconnected by an external force.

Meanwhile, an ink jet recording device has a recording characteristic recovery unit (hereinafter, also referred to as a recovery unit). In the ink jet recording apparatus, extremely small ink droplets (ink mist) are generated when ink is discharged from the discharge ports. The ink droplets may adhere to a discharge port side of the recording head (i.e., a surface where the discharge ports are made), or dust particles like those from paper may adhere to the discharge port side. Such an adhering matter may cause defective discharge of ink, thus degrading the quality of recording. To remove dust particles etc. adhering to the discharge port side, the recovery unit is generally used. The recovery unit uses a wiper made of an elastic material such as rubber, to wipe the discharge port side of the orifice plate 1111 and remove the ink droplets, dust particles, and the like.

FIGS. 16 and 17 are illustrations showing recovery processing at a discharge port side of a conventional recording head. FIG. 16 is a cross-sectional view showing the recording head during the recovery processing taken along a line XV-XV shown in FIG. 13. FIG. 17 is a cross-sectional view showing the recording head during the recovery processing taken along a line XIV-XIV shown in FIG. 13. A wiper 2500 moves on the discharge port side from the left side to the right side as shown in FIG. 16, or toward the far side in the longitudinal direction of the orifice plate 1111 as shown in FIG. 17, so as to wipe the discharge port side of the orifice plate 1111. Accordingly, the ink droplets and dust particles adhering to the discharge port side can be removed. At this time, the wiper 2500 contacts and wipes the discharge port side with a predetermined pressure by utilizing the elasticity of the wiper 2500, thereby removing the ink droplets and dust particles.

However, the stress of the sealant may cause a problem in relation to the wiper used during the wiping. In particular, a certain amount of sealant is necessary to be provided to attain the above-mentioned function. As shown in FIG. 17, a width W1 of the wiper 2500 is sufficiently larger than a width W2 of the recording element substrate 1100 in view of the manufacturing accuracy of the wiper 2500, the assembly accuracy of the wiper 2500 to a main body of the ink jet recording apparatus, the operation accuracy of the wiper 2500 during the wiping, etc. Owing to this, to prevent the wiper 2500 from contacting the wiring substrate 1300, a width W3 of the opening of the wiring substrate 1300 (or a width of an opening of the second plate 1400) to which the recording element substrate 1100 is mounted becomes sufficiently large. In such a case, to attain the function of the sealant, a relatively large amount of sealant is applied to the periphery of the recording element substrate 1100. Unfortunately, when selecting a sealant exhibiting a high adhesiveness with respect to a plurality of members, the choices are limited to a sealant whose internal stress is large after being cured, or one with a large coefficient of linear expansion. Such a sealant whose internal stress is large after being cured, or one with a large coefficient of linear expansion may cause an external force to be applied to the recording element substrate due to expansion and contraction of the sealant according to temperature change during a manufacturing procedure, or temperature change under an operating environment of a product. Due to this, the recording element substrate 1100 may become cracked.

In addition, a certain amount of sealant is necessary to prevent the upper edge of the recording element substrate 1100 from being exposed. This may also cause the recording element substrate 1100 to become damaged due to the internal stress of the sealant.

SUMMARY OF THE INVENTION

The present invention is directed to an ink jet recording head capable of preventing a recording element substrate from becoming cracked due to a sealant, and suppressing defective discharge of ink, and thus having a high reliability.

According to an aspect of the present invention, an ink jet recording head includes a recording element substrate. The recording element substrate has an array of discharge ports to discharge ink, an ink supply path penetrating the recording element substrate so as to supply ink to the discharge ports, and a side surface extending along an array direction of the discharge ports. The ink jet recording head also includes an opposite surface facing the side surface. In this head, a minimum distance is provided between the opposite surface and the side surface at least at a center portion of the side surface, and a distance greater than the minimum distance is provided between the opposite surface and the side surface at an end portion of the side surface in the array direction.

Further features of the present invention will become apparent from the following description of exemplary embodiments with reference to the attached drawings.

DESCRIPTION OF THE EMBODIMENTS

Embodiments of the present invention are described below with reference to the attached drawings.

Figure 1:
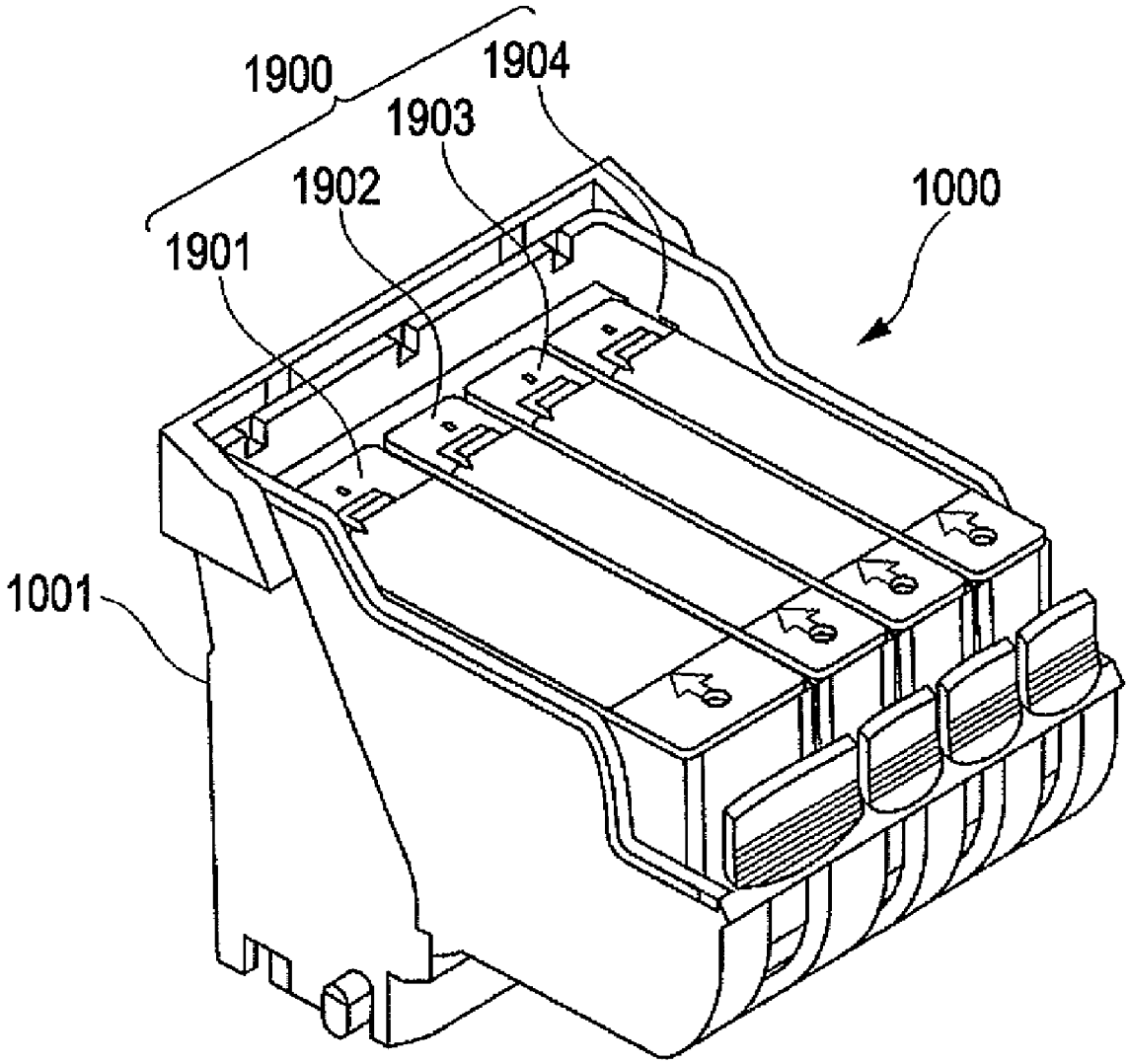
FIG. 1 is a perspective view showing a recording head cartridge according to an embodiment of the present invention.
Figure 2:
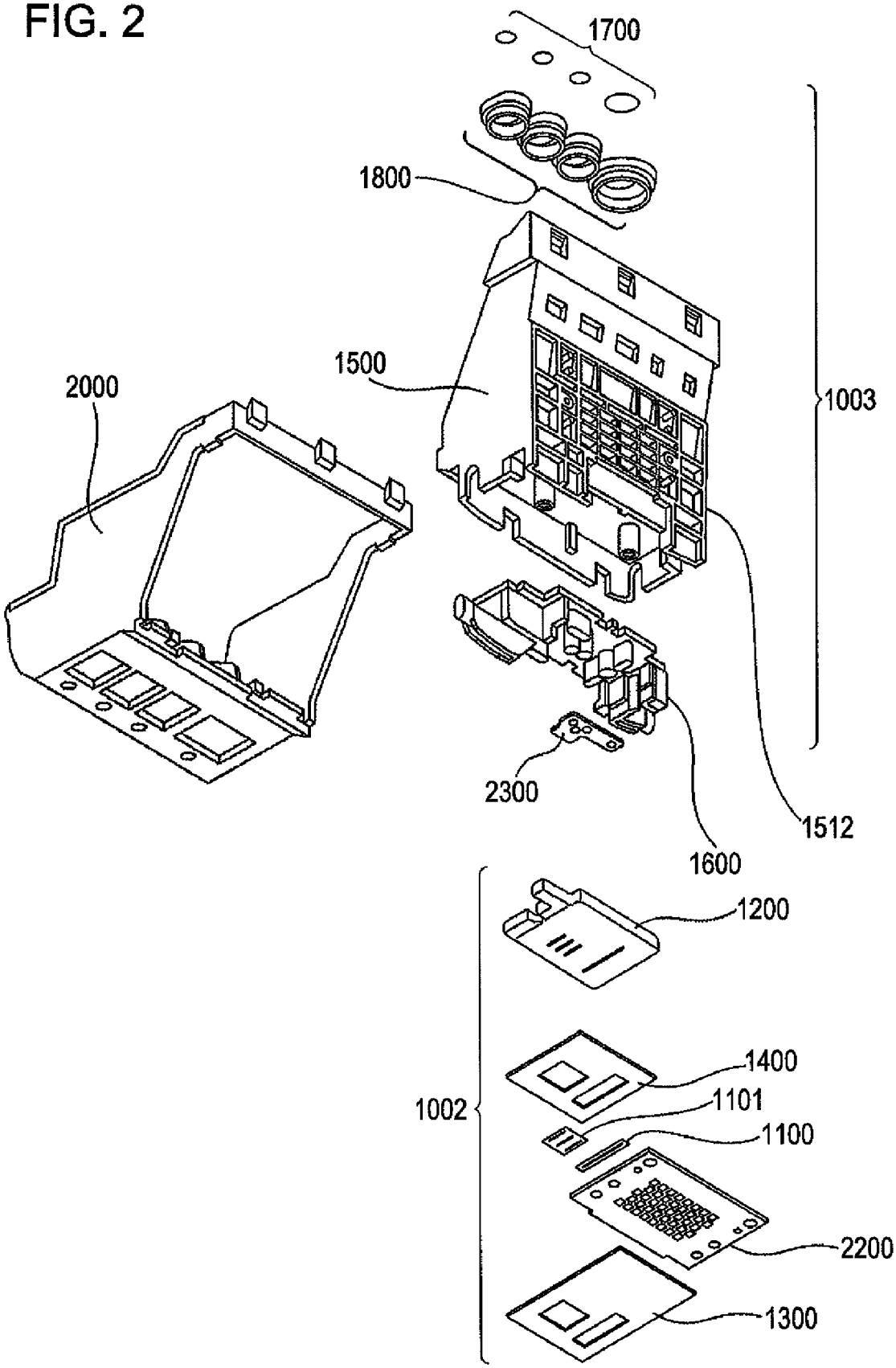
FIG. 2 is an exploded perspective view showing a recording head.
Figure 3:
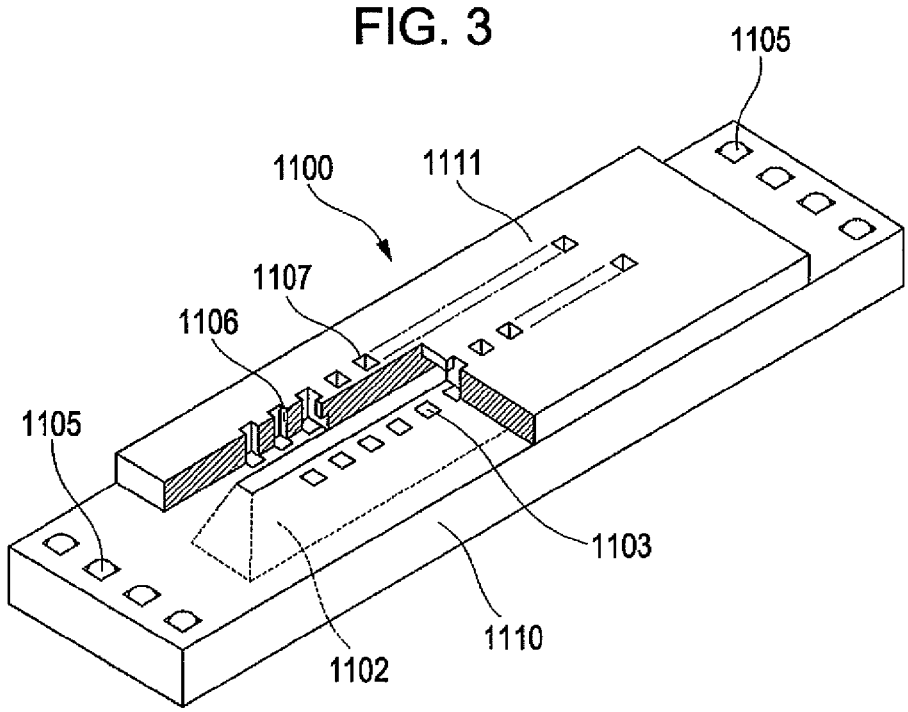
FIG. 3 is a perspective view showing a first recording element substrate with a part thereof being sectioned for convenience of description.

FIGS. 1 to 3 illustrate the relationship among a recording head cartridge to which the present invention may be applied, an ink jet recording head (hereinafter, also referred to as a recording head), and an ink container. Referring to these drawings, the components are described below.

FIG. 1 is a perspective view showing a recording head cartridge 1000 to which this embodiment may be applied. The recording head cartridge 1000 includes a recording head 1001, and an ink container 1900 mounted therein. The ink container 1900 has ink sub-containers 1901, 1902, 1903, and 1904, containing ink of different colors. In particular, the ink sub-containers 1901, 1902, 1903, and 1904 contain black ink, magenta ink, cyan ink, and yellow ink, respectively.

FIG. 2 is an exploded perspective view showing the recording head 1001. The recording head 1001 in this embodiment is an ink jet recording head in which an electric signal is sent to an electrothermal transducer, to cause film boiling in ink in accordance with the signal. With the energy of the film boiling, the ink is discharged for recording. As shown in FIG. 2, the recording head 1001 includes a recording element unit 1002, an ink supply unit 1003, and a container holder 2000.

Referring to FIG. 2, the recording element unit 1002 has a first recording element substrate 1100, a second recording element substrate 1101, a first plate 1200, a wiring substrate 1300, an electric contact substrate 2200, and a second plate 1400. The ink supply unit 1003 has an ink supply member 1500, a passage forming member 1600, a joint rubber 2300, filters 1700, and seal rubbers 1800.

For example, the ink supply member 1500 is molded of a resin material. To increase the rigidity of the ink supply member 1500, a glass filler may be mixed to the resin material by an amount ranging from 5% to 40%. The ink supply member 1500 is a component of the ink supply unit 1003 to guide the ink from the ink container 1900 to the recording element unit 1002. The passage forming member 1600 is welded to the ink supply member 1500 to form an ink passage (not shown). The filters 1700 are bonded to the ink supply member 1500 by welding to prevent dust particles entering from the outside, and the seal rubbers 1800 are mounted thereon to prevent the ink from evaporating. The ink supply member 1500 also has a terminal fixing portion 1512 that positions and fixes the electric contact substrate 2200 of the recording element unit 1002. A plurality of ribs are provided at the terminal fixing portion 1512 and its periphery, so as to increase the rigidity of the surface with the terminal fixing portion 1512.

FIG. 3 is a perspective view showing the first recording element substrate 1100 of this embodiment with a part thereof being sectioned for convenience of description. The first recording element substrate 1100 is a recording element substrate for discharging the black ink. The first recording element substrate 1100 can have a silicon (Si) substrate 1110 with a thickness ranging from 0.5 to 1 mm, an ink supply port 1102 formed in the Si substrate 1110 by anisotropic etching or the like, and two arrays of electrothermal transducers 1103 disposed on both sides of the ink supply port 1102. The electrothermal transducers 1103 and electric wiring (not shown) made of Al or the like for supplying power to the electrothermal transducers 1103 are formed by depositing a semiconductor film. A plurality of bumps 1105 made of Au or the like are arranged on the first recording element substrate 1100 at both ends in an array direction of the electrothermal transducers 1103, the both ends being connection portions of the electric wiring with respect to an external wiring. An orifice plate 1111 made of resin is provided on the Si substrate 1110. The orifice plate 1111 has ink passage walls 1106 and discharge ports 1107 corresponding to the electrothermal transducers 1103.

Since the discharge ports 1107 face the electrothermal transducers 1103, the ink supplied from the ink supply port 1102 is heated by the electrothermal transducers 1103, causing bubbles in the ink, and the ink is discharged from the discharge ports 1107.

The second recording element substrate 1101 in this embodiment is a recording element substrate for discharging ink of three colors of magenta, cyan, and yellow. The second recording element substrate 1101 has a structure such as the three first recording element substrates 1100 shown in FIG. 2 arranged in parallel on a substrate.

Figure 4:
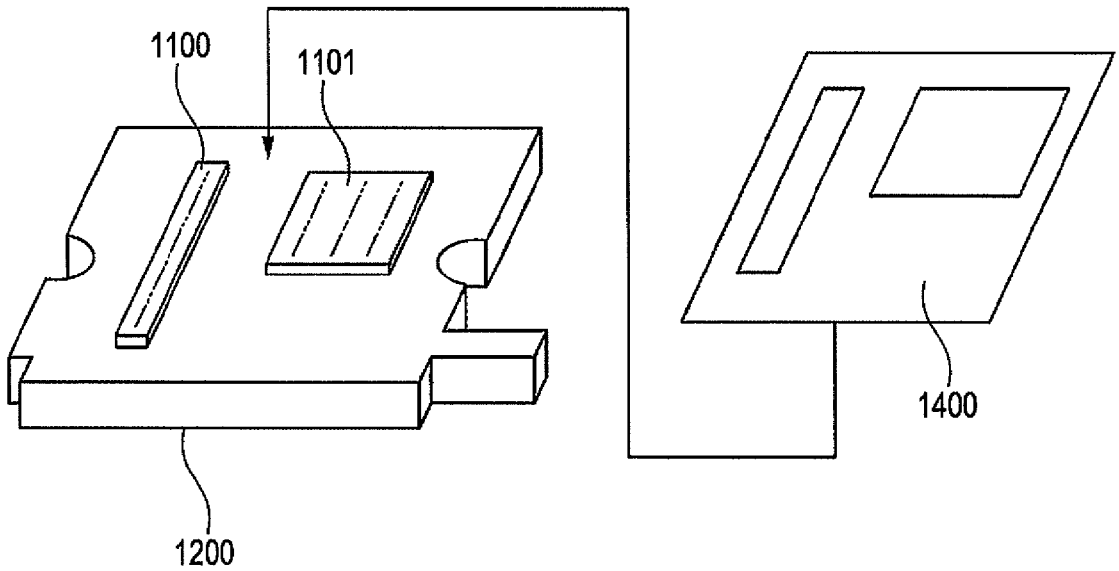
FIG. 4 is an illustration showing a procedure for mounting a second plate on a first plate, the first plate having first and second recording element substrates bonded and fixed thereon.
Figure 5:
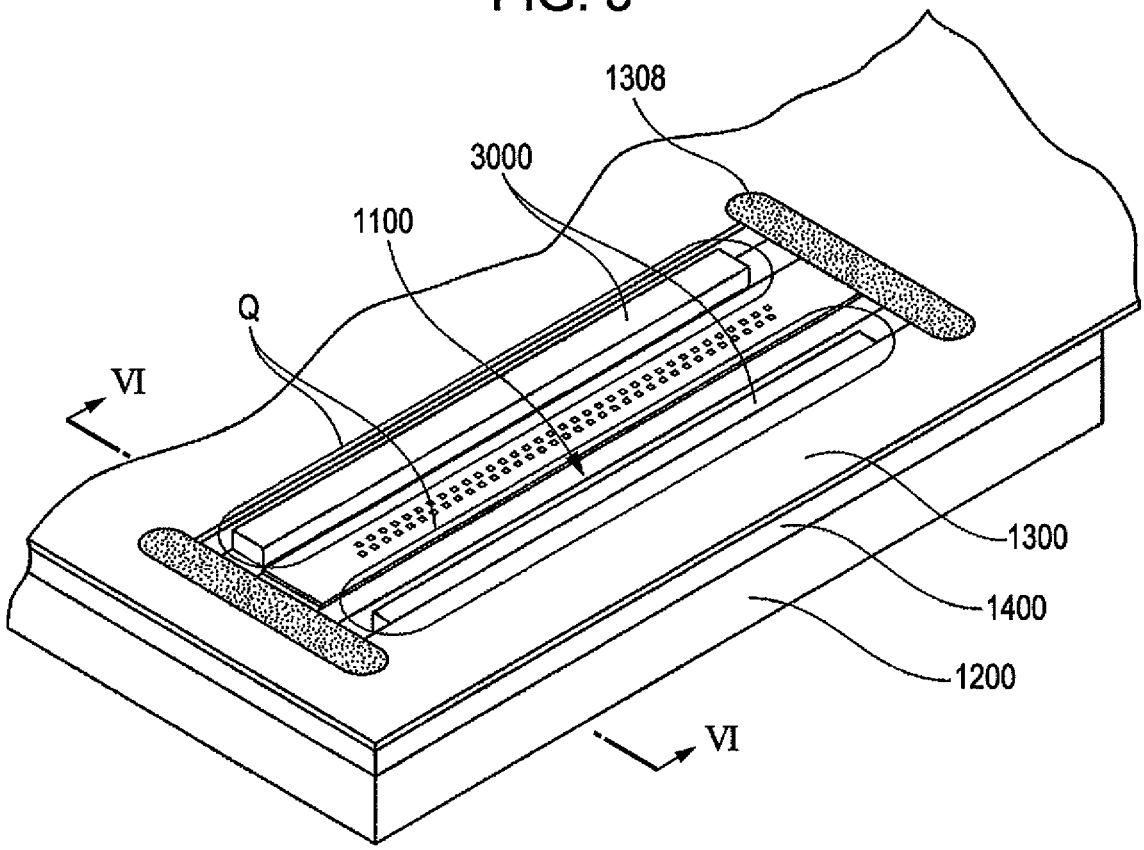
FIG. 5 is an enlarged perspective view showing a part of a recording element unit.
Figure 6:
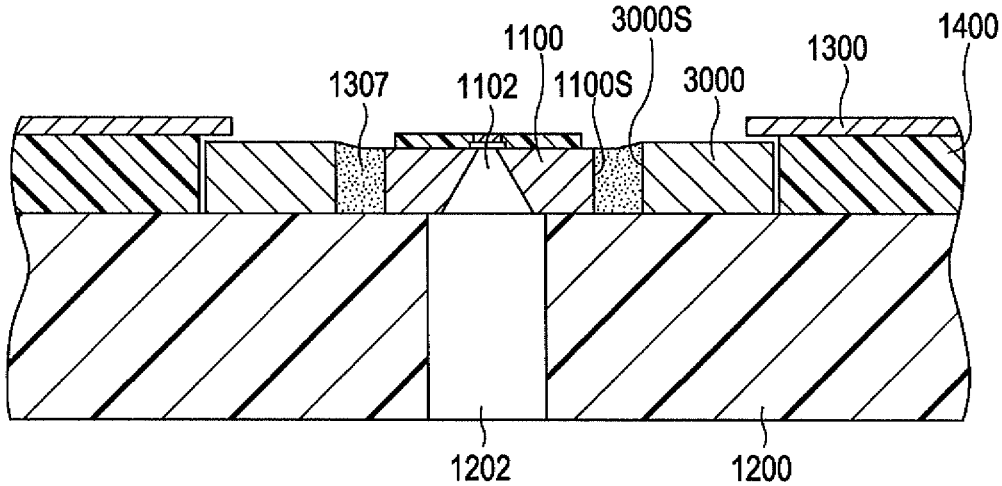
FIG. 6 is a cross-sectional view taken along a line VI-VI shown in FIG. 5.

FIG. 4 is an illustration showing a procedure for mounting the second plate 1400 on the first plate 1200, the first plate 1200 having the first and second recording element substrates 1100 and 1101 bonded and fixed thereon. Also, FIG. 5 is an enlarged perspective view showing a part of the recording element unit 1002 of this embodiment. FIG. 6 is a cross-sectional view taken along a line VI-VI shown in FIG. 5. For convenience of description, a part of a first sealant 1307 is not illustrated in FIG. 5.

For example, the first plate 1200 is made of an alumina ($Al_2O_3$) material with a thickness ranging from 0.5 to 1 mm. The material of the first plate 1200 is not limited thereto. The first plate 1200 may be made of a material having a coefficient of linear expansion similar to that of the material of the recording element substrate 1100, and having a thermal conductivity similar to or greater than that of the material of the recording element substrate 1100. Such a material may be silicon (Si), molybdenum (Mo), aluminum nitride (AlN), zirconia ($ZrO_2$), silicon nitride ($Si_3N_4$), tungsten (W), or the like. The first plate 1200 has an ink supply path 1202 that supplies ink to the first recording element substrate 1100, and ink supply paths 1202 (not shown) that supply ink to the second recording element substrate 1101. The first and second recording element substrates 1100 and 1101 are bonded and fixed on the first plate 1200 with a high positional accuracy such that these ink supply paths 1202 respectively communicate with the ink supply ports 1102 of the first and second recording element substrates 1100 and 1101. The adhesive used for bonding the first plate 1200 and the first and second recording element substrates 1100 and 1101 may be one having a low viscosity, a low curing temperature, a short curing time, a relatively high rigidity after being cured, and ink-resistant characteristic. For example, the adhesive may be a thermosetting adhesive mainly composed of epoxy resin, and the thickness of the adhesive layer may be 50 μm or smaller.

The second plate 1400 is a plate member made of ceramic such as alumina ($Al_2O_3$), or a metal material such as Al or SUS, for instance, with a thickness ranging from 0.5 to 1 mm. The second plate 1400 has side edges that define openings corresponding to the first and second recording element substrates 1100 and 1101 fixed on the first plate 1200. The openings have dimensions respectively greater than those of the first and second recording element substrates 1100 and 1101. The second plate 1400 is bonded and fixed on the first plate 1200 such that the peripheries of the recording element substrates are surrounded by the side edges of the second plate 1400.

The wiring substrate 1300 applies electric signals for discharging ink to the first and second recording element substrates 1100 and 1101. The wiring substrate 1300 has lead terminals (not shown) corresponding to the bumps 1105 of the first and second recording element substrates 1100 and 1101. The wiring substrate 1300 is electrically connected to the recording element substrates 1100 and 1101, for instance, by heat ultrasonic bonding.

Gaps between the second plate 1400 and the first and second recording element substrates 1100 and 1101 are filled with a first sealant 1307 to prevent the first and second recording element substrates 1100 and 1101 from being corroded by ink. Also, the lead terminals connecting the wiring substrate 1300 and the bumps 1105 provided on the recording element substrate 1100 are covered with a second sealant 1308 to prevent the lead terminals from being corroded by ink and lead wires from being disconnected by an external force.

Referring to FIGS. 5 and 6, the first recording element substrate 1100 is described below as an example of the characteristic configurations according to the embodiment of the present invention. Note that the second recording element substrate 1101 is similar to the first recording element substrate 1100.

In this embodiment, a protrusion 3000 is provided in a space Q defined between a longitudinal side surface 1100S of the first recording element substrate (hereinafter, merely referred to as a recording element substrate) 1100 and a side edge (opening) of the second plate 1400 facing the longitudinal side surfaces 1100S. That is, the structure may narrow a gap defined between a side 3000S of each protrusion 3000 and the side surface 1100S of the recording element substrate extending in the longitudinal direction (i.e., the array direction of the discharge ports 1107 and the longitudinal direction of the opening of the ink supply port 1102). The gap between the recording element substrate 1100 and the second plate 1400 is filled with the first sealant 1307, however, the first sealant 1307 is not illustrated in FIG. 5.

The protrusion 3000 does not extend over the entire length of the space Q. A predetermined space is provided between an end portion in the longitudinal direction of the protrusion 3000 and the second plate 1400. The space is provided because a needle for injecting sealant is inserted when the first sealant 1307 is injected. In the short side direction of the space Q, the protrusion 3000 does not extend over the entire width. As shown in FIG. 5, a predetermined gap is provided between an end portion in the short side direction of the protrusion 3000 and the second plate 1400 or the recording element substrate 1100.

As described above, since the protrusion 3000 is provided in the space Q defined between the recording element substrate 1100 and the second plate 1400, the gap between the longitudinal side surface 1100S of the recording element substrate 1100 and the side 3000S of the protrusions 3000 can be narrowed. With this configuration, an amount of the first sealant 1307 corresponding to a volume of a region occupied by the protrusion 3000 can be reduced. The reduction in the amount of the first sealant 1307 may markedly reduce the internal stress of the first sealant 1307 after being cured, and the contraction stress due to temperature change applied to the recording element substrate 1100. Accordingly, the recording element substrate 1100 can be prevented from becoming cracked. The amount of first sealant 1307 to be injected is reduced; however, the positional relationship between the recording element substrate 1100 and the liquid level of the first sealant 1307 is not changed. In particular, the liquid level of the first sealant 1307 is almost as high as a bonding surface of the recording element substrate 1100 with respect to the orifice plate 1111 (hereinafter, also referred to as an upper surface of the recording element substrate 1100), and hence, an edge of the recording element substrate 1100 is not exposed. Accordingly, even when a wiper wipes a discharge port side of the orifice plate 1111, the wiper does not interfere with the edge of the recording element substrate 1100. Thus, the wiper is not chipped by the edge.

The material of the protrusion 3000 may be ceramic such as alumina ($Al_2O_3$), a metal material such as Al or SUS, or a heat-resistant resin material such as PPS. The coefficient of linear expansion of the material may be as small as possible. In this embodiment, the protrusion 3000 is made of Alumina ($Al_2O_3$).

The dimensions of the members used in this embodiment are as follows. The thickness of the recording element substrate 1100 is about 0.6 mm, the thickness of the first plate 1200 is about 2 mm, the thickness of the second plate 1400 is about 0.7 mm, the thickness of the wiring substrate 1300 is about 0.1 mm, and the thickness of the protrusion 3000 is about 0.5 mm. The width of the recording element substrate 1100 is about 2 mm, the distance between the recording element substrate 1100 and the second plate 1400 is about 2 mm, the distance between the side surface 1100S of the recording element substrate 1100 and the side 3000S of the protrusion 3000 is about 0.5 mm at the minimum distance. The distance between the end portion in the longitudinal direction of the protrusion 3000 and the second plate 1400 is about 2 mm.

As shown in FIG. 6, the height from a bonding surface of the first plate 1200 for the recording element substrate 1100 (hereinafter, also referred to as an upper surface of the first plate 1200) to a surface of the protrusion 3000 facing the wiper during the recovery processing (hereinafter, also referred to as an upper surface of the protrusion 3000) is smaller than the height from the upper surface of the first plate 1200 to the discharge port side of the orifice plate 1111. Accordingly, the wiper does not interfere with the protrusion 3000 when the wiper wipes the discharge port side of the orifice plate 1111.

In FIG. 6, while the wiring substrate 1300 protrudes from the second plate 1400, the end of the wiring substrate 1300 may correspond to the end of the second plate 1400. Alternatively, the second plate 1400 may protrude from the wiring substrate 1300 in an opposite manner to the configuration shown in FIG. 6.

Figure 7:
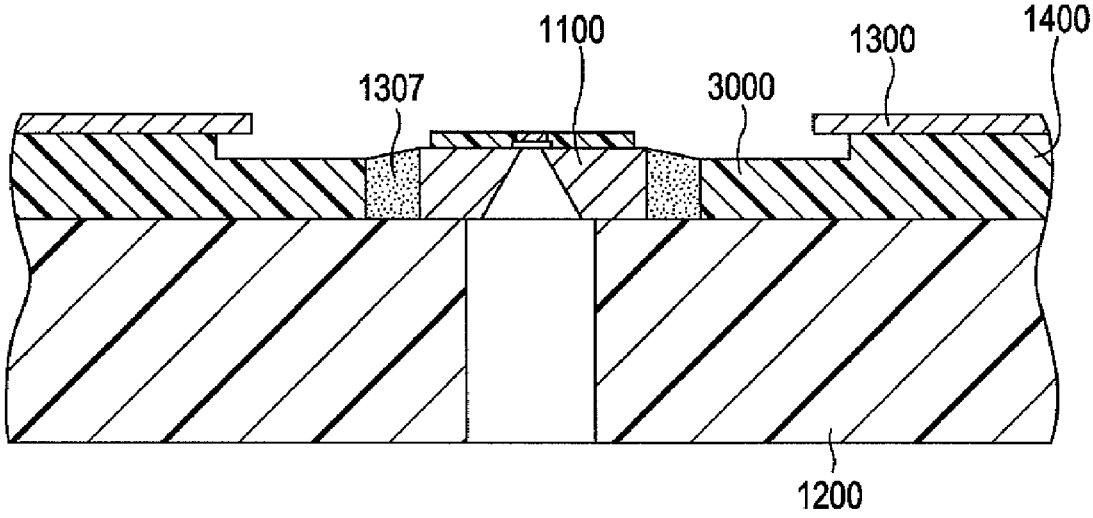
FIG. 7 is a cross-sectional view showing modification of a protrusion.
Figure 8:
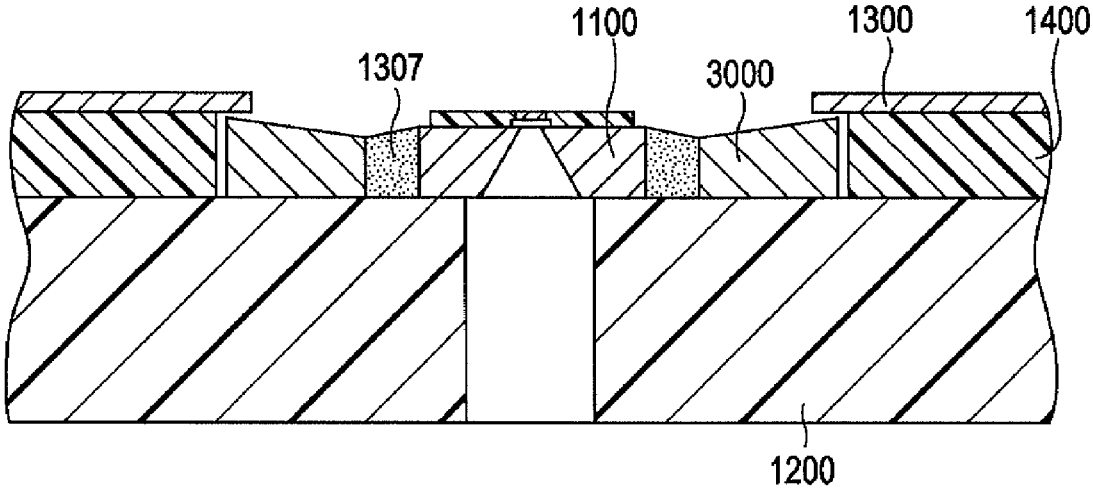
FIG. 8 is a cross-sectional view showing another modification of a protrusion.

In FIG. 6, while a gap is provided between the second plate 1400 and the protrusion 3000, both components may be provided without the gap. Alternatively, the protrusion 3000 may be block members arranged on the first plate 1200, or a rib structure protruding from the first plate 1200. Still alternatively, as shown in FIG. 7, the protrusion 3000 may be integrated with the second plate 1400. With this arrangement, the protrusion may be formed in a simple manner. Also, in FIG. 6, while the cross-sectional profile of the protrusion 3000 is rectangular, it is not limited thereto. The cross-sectional profile of the protrusion 3000 may be any shape as long as the height of the protrusion 3000 from the upper surface of the first plate 1200 is smaller than the height of the orifice plate 1111 of the recording element substrate 1100, and a predetermined gap is provided between the protrusion 3000 and the recording element substrate 1100. For example, the protrusion 3000 may have a trapezoidal cross-sectional profile as shown in FIG. 8. These formation manners of the protrusion may be applied to various protrusions described below.

Referring to FIGS. 9A, 9B, 10A, and 10B, first and second embodiments of the present invention are described.

Figure 9A:
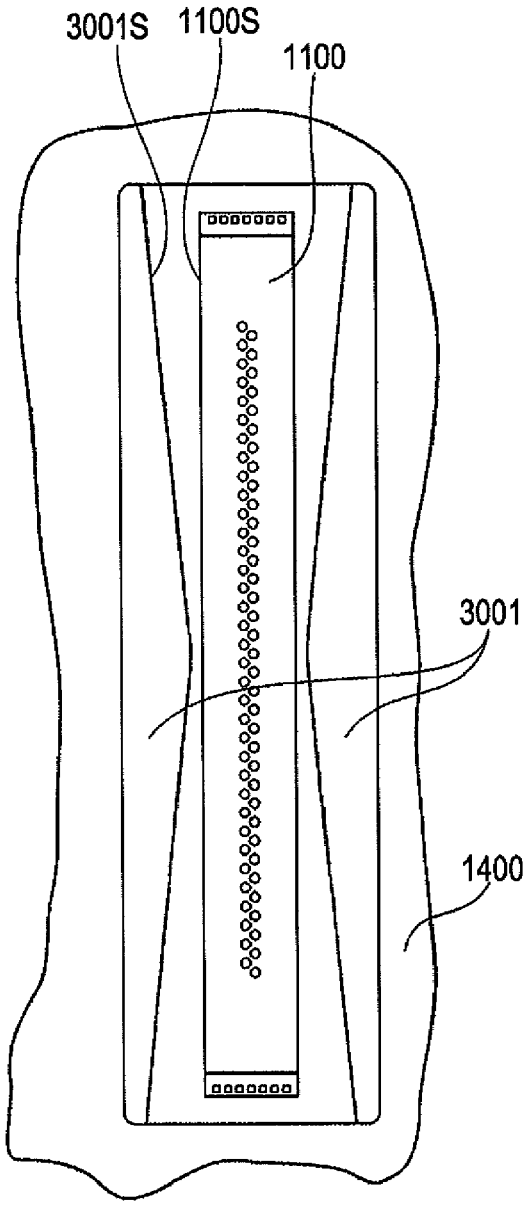
FIG. 9A is an illustration showing a part of a recording element unit according to an example of a first embodiment.
Figure 9B:
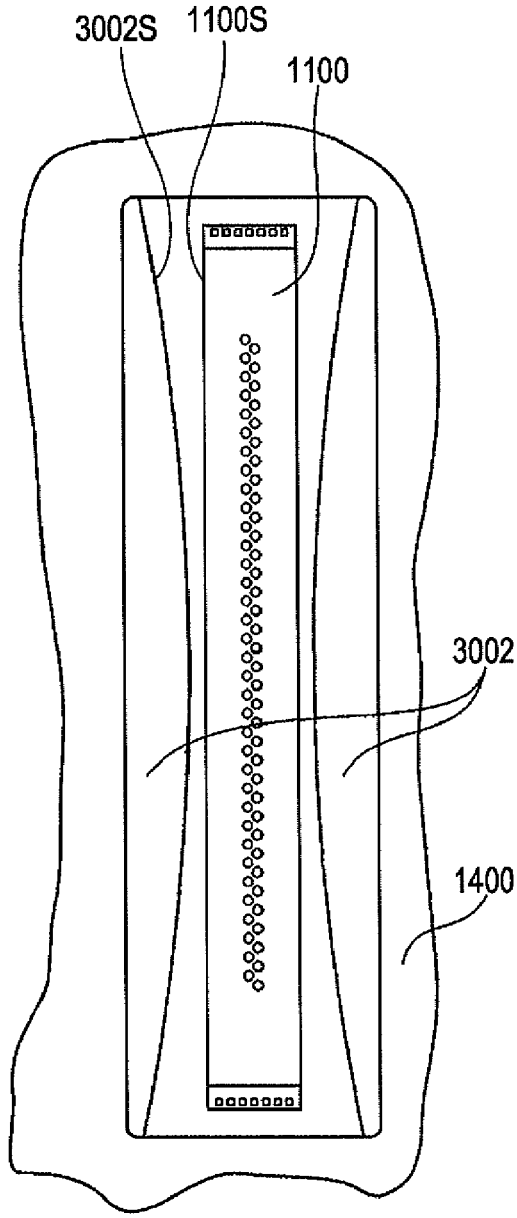
FIG. 9B is an illustration showing a part of a recording element unit according to another example of the first embodiment.

FIGS. 9A and 9B are illustrations each showing a part of a recording element unit 1002 according to the first embodiment.

In FIG. 9A, a protrusion 3001 is provided between the recording element substrate 1100 and the second plate 1400 such that a gap defined between a side 3001S of the protrusion 3001 and the side surface 1100S in the longitudinal directions of the recording element substrate 1100 has a width which is narrowed toward a center portion in the longitudinal direction of the protrusion 3001 at a constant rate.

In FIG. 9B, a protrusion 3002 is provided such that a gap defined between a side 3002S of the protrusion 3002 and the side surface 1100S in the longitudinal direction of the recording element substrate 1100 has a width which is narrowed toward a center portion in the longitudinal direction of the protrusion 3002 at a varying rate. In both examples, a distance between the protrusion 3001 or 3002 and the recording element substrate 1100 becomes minimum (minimum distance) at least at a center portion in the longitudinal direction of the recording element substrate 1100. As shown in FIG. 3, the elongated ink supply port 1102 is formed by penetrating the recording element substrate 1100, the ink supply port 1102 extending along the longitudinal direction of the recording element substrate 1100 (i.e., the array direction of the discharge ports 1107). Owing to this, the recording element substrate 1100 may become damaged easily when a pressure is applied to its side surface 1100S. The center portion in the longitudinal direction of the recording element substrate 1100 is the most fragile portion with respect to the pressure applied from the side surface 1100S. In the first embodiment, the minimum distance is provided between the recording element substrate 1100 and the protrusion 3001 or 3002 at least at the center portion in the longitudinal direction of the recording element substrate 1100. This configuration may reduce the pressure applied by the first sealant 1307 to the most fragile portion.

In the examples of the first embodiment, the protrusion 3001 or 3002 extends over the entire region in the longitudinal direction of the side edge of the second plate 1400. In addition, at least at an end portion in the longitudinal direction of the recording element substrate 1100, the distance between the side surface 1100S and the side 3001S, or between the side surface 1100S and the side 3002S, is greater than the minimum distance located at the center portion of the recording element substrate 1100. This relatively large space at the end portion of the recording element substrate 1100 between the protrusion and the recording element substrate 1100 may prevent the needle from interfering with the recording element substrate and the like when the first sealant 1307 is injected to the space Q.

A thermal shock test, a proof test at high temperature and humidity, and a proof test at a very low temperature were performed for the recording head 1001 having the above-described configuration. As a result, no crack was found in the recording element substrate 1100. In addition, a wiping test was performed for the recording head 1001. As a result, the wiper did not interfere with the edge of the recording element substrate 1100, and thus the wiper was not chipped.

Figure 10A:
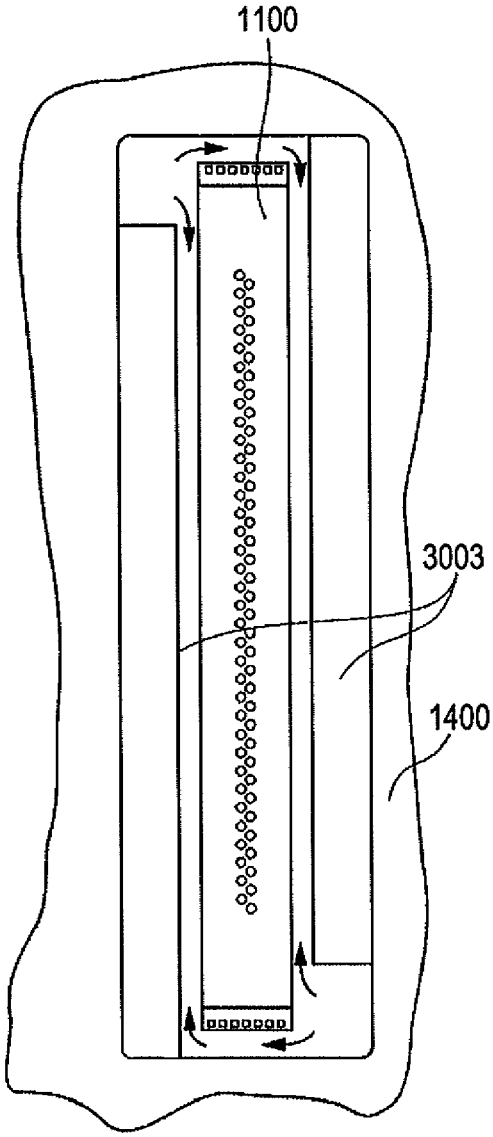
FIG. 10A is an illustration showing a part of a recording element unit according to an example of a second embodiment.
Figure 10B:
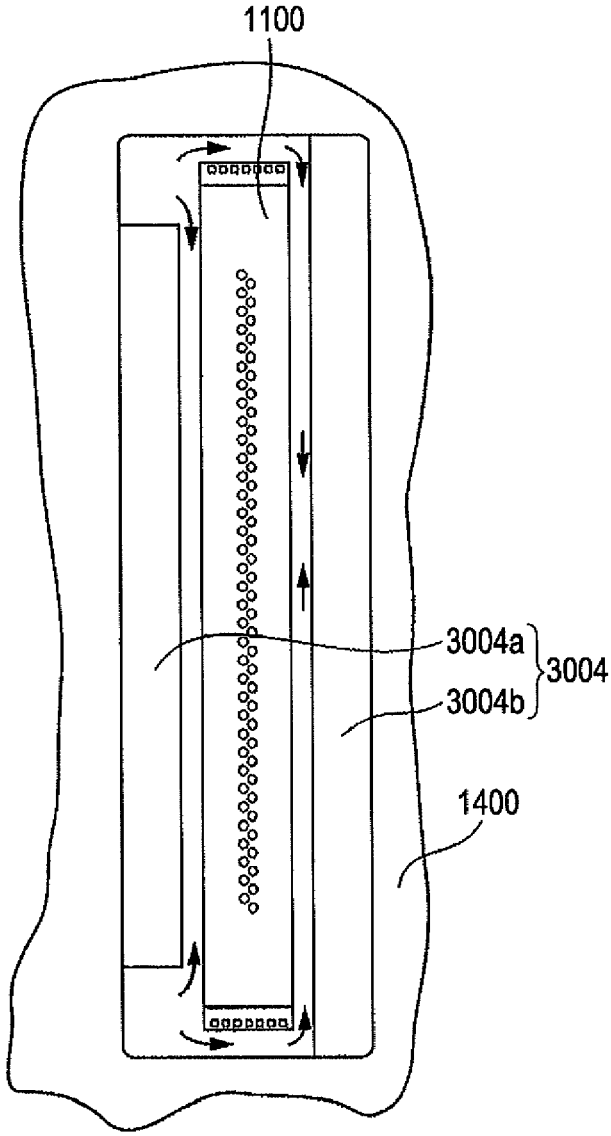
FIG. 10B is an illustration showing a part of a recording element unit according to another example of the second embodiment.

FIGS. 10A and 10B are illustrations each showing a part of a recording element unit 1002 according to the second embodiment.

In FIG. 10A, a protrusion 3003 is provided between the recording element substrate 1100 and the second plate 1400 such that at least an end portion in the longitudinal direction of the protrusion 3003 contacts the second plate 1400. The distance between the side surface in the longitudinal direction of the recording element substrate 1100 and the side of the protrusion 3003 facing the side surface is minimum at the center portion in the longitudinal direction of the recording element substrate 1100, and the minimum distance is applied to the entire region in the longitudinal direction of the recording element substrate 1100. Accordingly, the space to which the needle is inserted for injecting the first sealant 1307 is provided at the end portion in the longitudinal direction of the recording element substrate 1100, i.e., only at one side in the longitudinal direction of the protrusion 3003. However, the first sealant 1307 may be injected by utilizing the flow of the first sealant 1307 as indicated by arrows in the drawing.

In FIG. 10B, protrusions 3004 are provided between the recording element substrate 1100 and the second plate 1400, and include a protrusion 3004*a* and a protrusion 3004*b*. The protrusion 3004*a* has a space between each end portion thereof in the longitudinal direction and the second plate 1400, whereas the protrusion 3004*b* has no space between each end portion thereof in the longitudinal direction and the second plate 1400. The distance between the side surface in the longitudinal direction of the recording element substrate 1100 and the side of the protrusion 3004*a* or 3004*b* facing the side surface is minimum at the center portion in the longitudinal direction of the recording element substrate 1100, and the minimum distance is applied to the entire region in the longitudinal direction of the recording element substrate 1100. In addition, spaces are provided at both end portions of the recording element substrate 1100, the spaces are larger than the gap having the minimum distance with respect to the protrusion 3004*a* at the center portion in the longitudinal direction of the recording element substrate 1100. The needle is inserted to the spaces for injecting the first sealant 1307. The protrusion 3004*b* has no space to which the needle is inserted for injecting the first sealant 1307. However, the first sealant 1307 may be injected by utilizing the flow of the first sealant 1307 as indicated by arrows in the drawing. The protrusions 3003 and 3004 may have a shape employed for the protrusions 3001 and 3002 shown in FIGS. 9A and 9B.

A thermal shock test, a proof test at high temperature and humidity, and a proof test at a very low temperature were performed for the recording head 1001 having the above-described configuration. As a result, no crack was found in the recording element substrate 1100. In addition, a wiping test was performed for the recording head 1001. As a result, the wiper did not interfere with the edge of the recording element substrate 1100, and thus the wiper was not chipped.

Next, a third embodiment of the present invention is described with reference to FIGS. 11A and 11B.

Figure 11A:
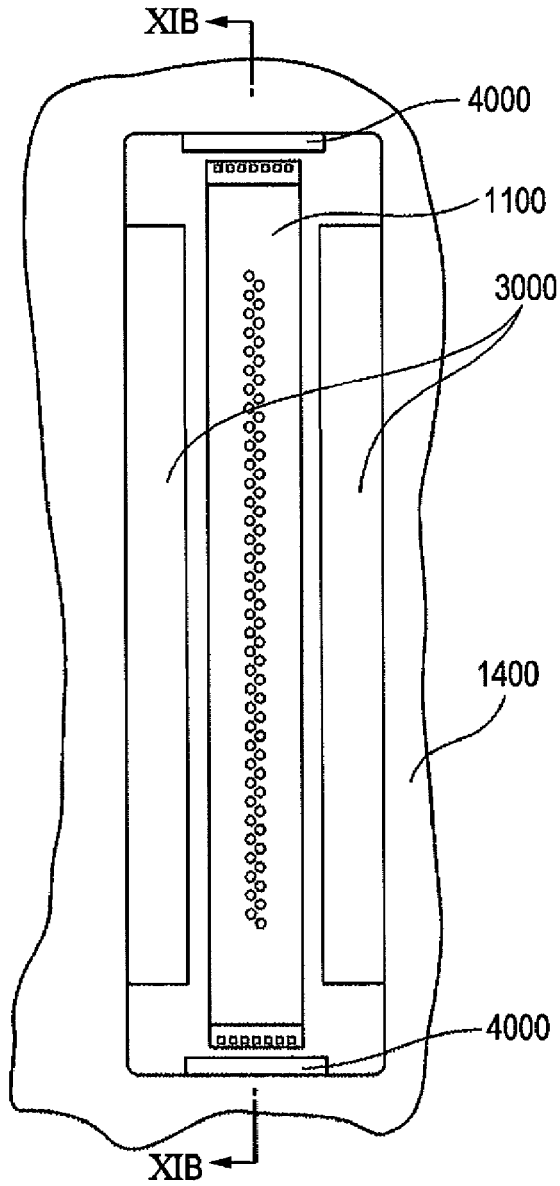
FIG. 11A is an illustration showing a part of a recording element unit according to a third embodiment.
Figure 11B:
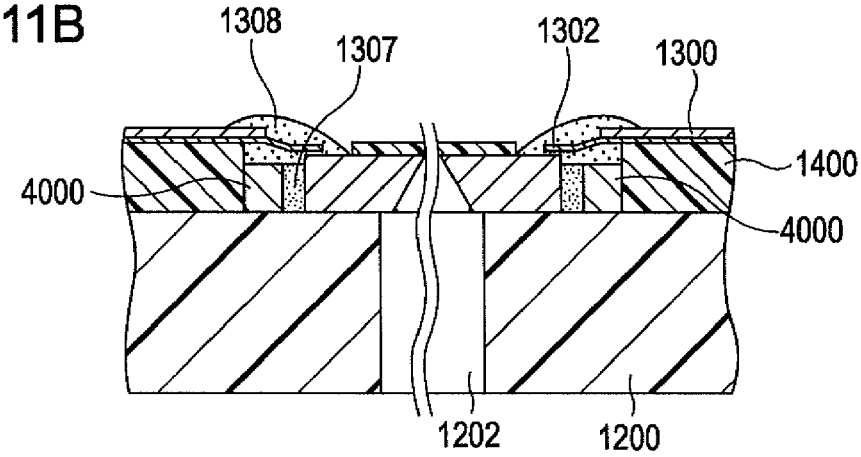
FIG. 11B is a cross-sectional view taken along a line XIB-XIB shown in FIG. 11A.

FIG. 11A is an illustration showing a part of a recording element unit 1002 according to the third embodiment. FIG. 11B is a cross-sectional view taken along a line XIB-XIB shown in FIG. 11A. The third embodiment provides an arrangement similar to the arrangement of the recording element substrate and the protrusion of the second embodiment, except that the protrusion is not formed at both end portions in the longitudinal direction of the recording element substrate 1100. Also, a protrusion 4000 is provided in a space extending in each end portion in the longitudinal direction of the recording element substrate 1100. The protrusion 4000 has a structure similar to that of the above-mentioned protrusion 3000 and the like. With the provision of the protrusion 4000, the amount of first sealant 1307 to be injected is further reduced. This may markedly reduce the contraction stress of the first sealant 1307 due to temperature change applied to the recording element substrate 1100. As a result, the recording element substrate 1100 can be prevented from becoming cracked. The portion provided with the protrusion 4000 is covered with the second sealant 1308 to protect lead terminals 1302 after the first sealant 1307 is injected. Regardless of the amount of first sealant 1307, this portion does not cause the wiper to be chipped when wiping the discharge port side.

Next, a fourth embodiment of the present invention is described with reference to FIG. 12.

Figure 12:
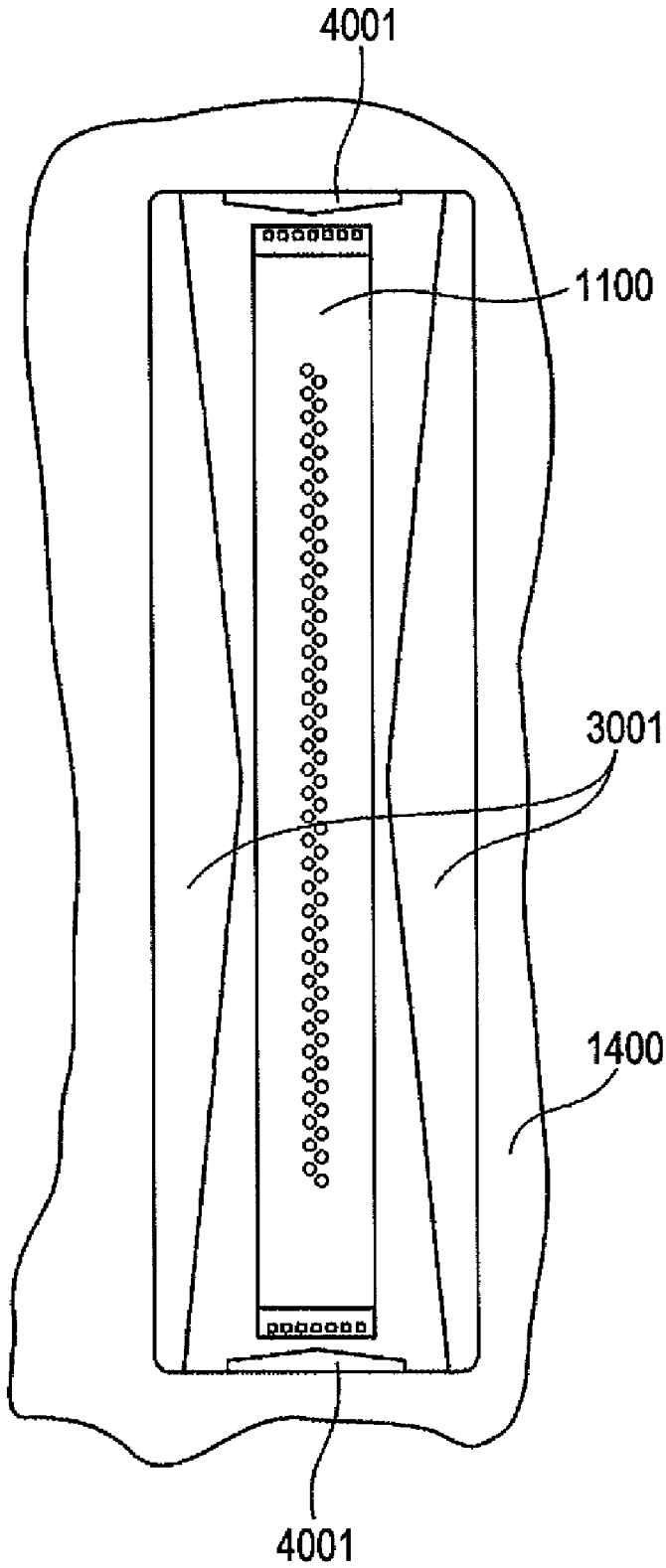
FIG. 12 is an illustration showing a part of a recording element unit according to a fourth embodiment.
Figure 13:
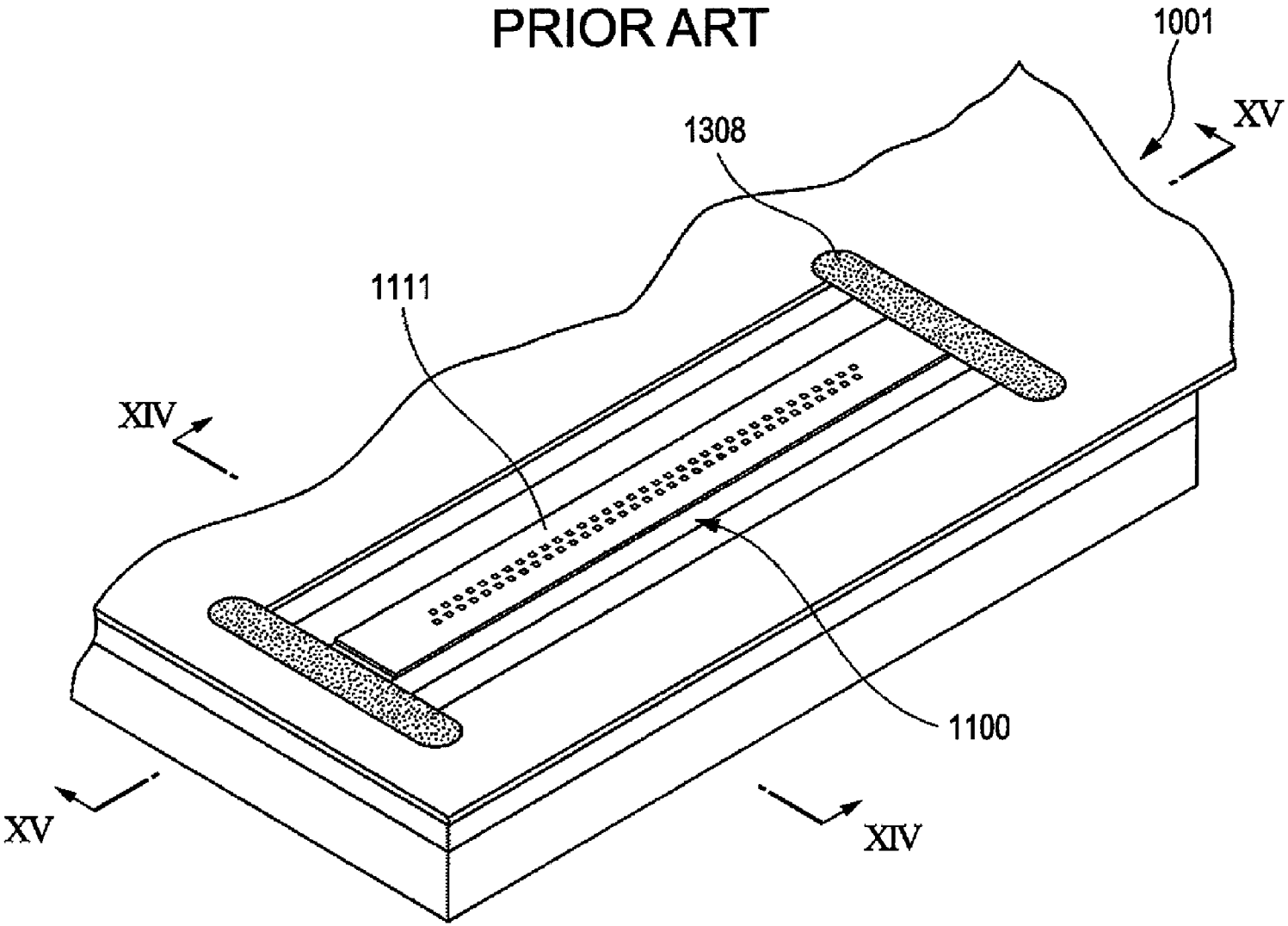
FIG. 13 PRIOR ART
FIG. 13 is a perspective view showing a state where a recording element substrate of a related art is embedded in a recording head.
Figure 14:
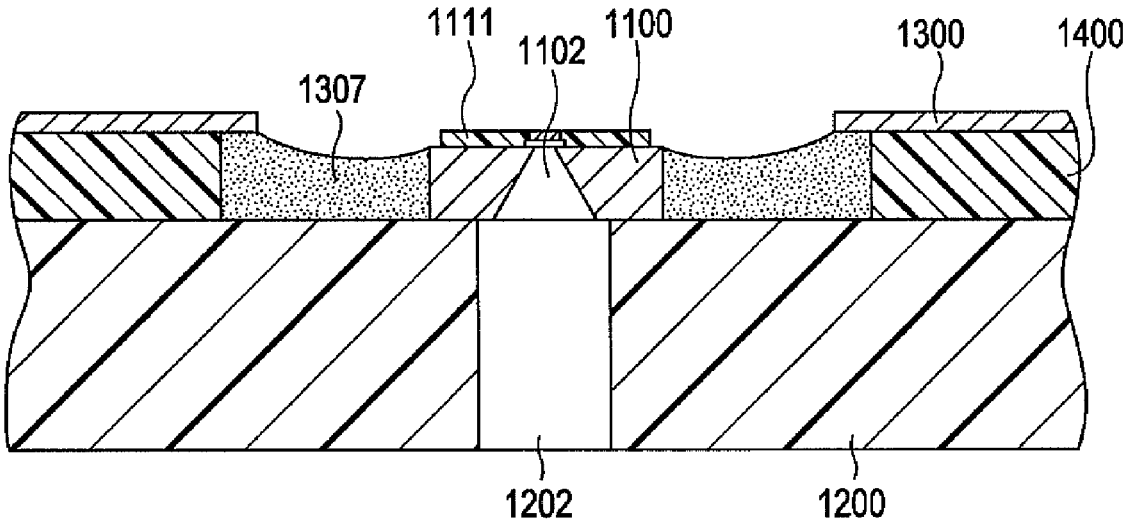
FIG. 14 PRIOR ART
FIG. 14 is a cross-sectional view taken along a line XIV-XIV shown in FIG. 21.
Figure 15:
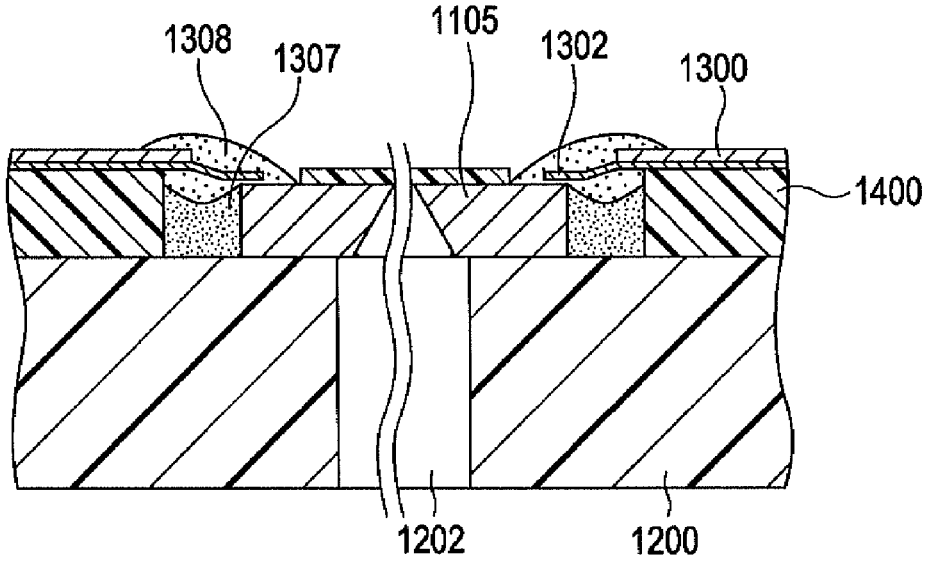
FIG. 15 PRIOR ART
FIG. 15 is a cross-sectional view taken along a line XV-XV shown in FIG. 21.
Figure 16:
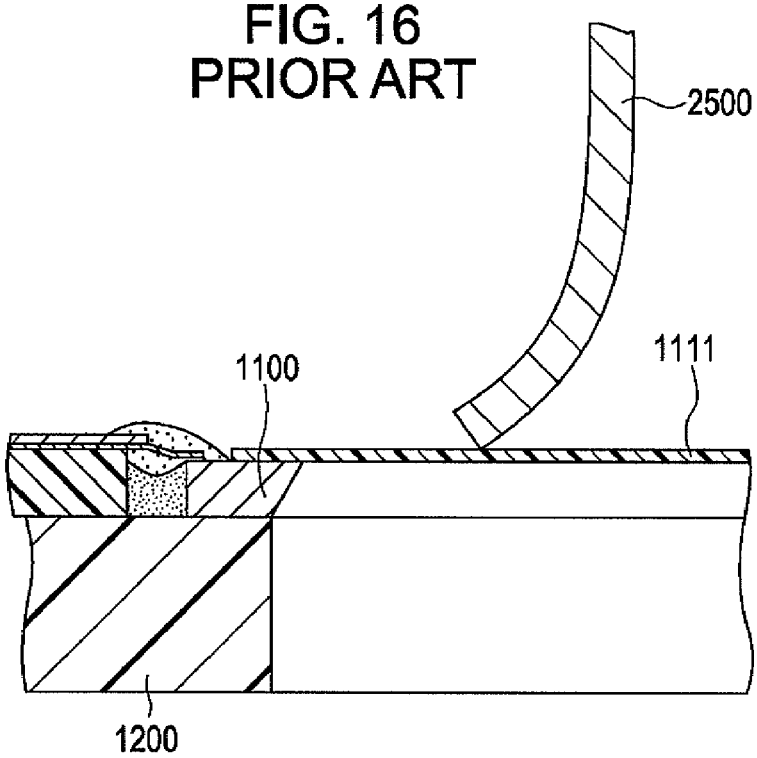
FIG. 16 PRIOR ART
FIG. 16 is a view showing recovery processing taken along a line XV-XV shown in FIG. 13.
Figure 17:
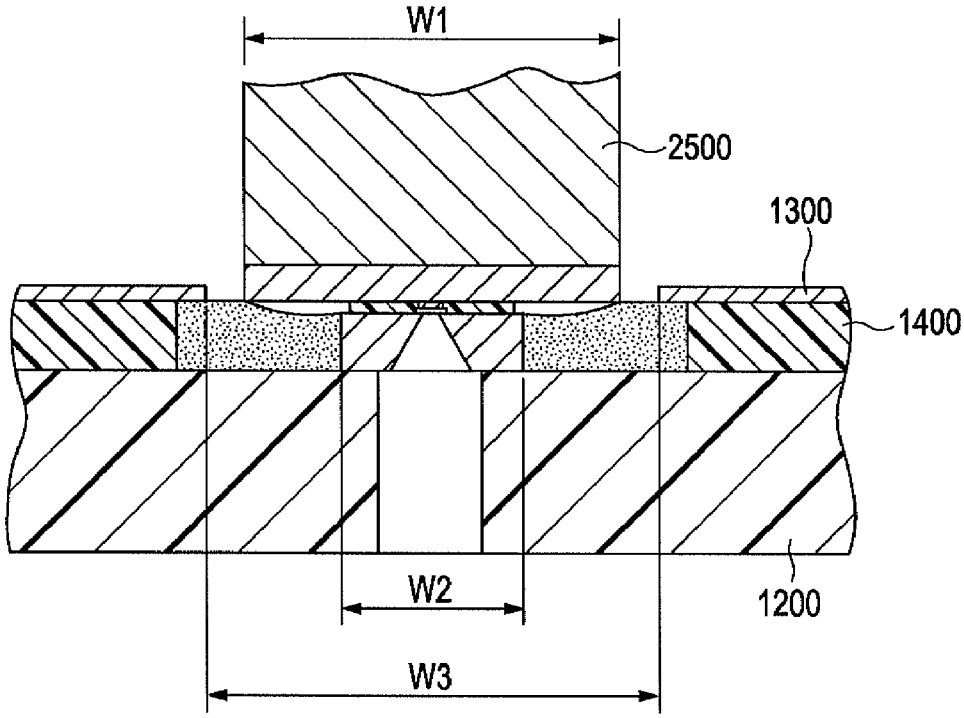
FIG. 17 PRIOR ART
FIG. 17 is a view showing the recovery processing taken along a line XIV-XIV shown in FIG. 13.

FIG. 12 is an illustration showing a part of a recording element unit 1002. The protrusion 3000 provided between the recording element substrate 1100 and the second plate 1400 has the same arrangement as that of the first embodiment. In addition, a protrusion 4001 is disposed along each side surface in the short side direction of the recording element substrate 1100. The distance between each protrusion 4001 and the recording element substrate 1100 becomes a minimum at least at a center portion of the side surface in the short side direction of the recording element substrate 1100.

A thermal shock test, a proof test at high temperature and humidity, and a proof test at a very low temperature were performed for the recording head 1001 having the above-described configuration. As a result, no crack was found in the recording element substrate 1100. In addition, a wiping test was performed for the recording head 1001. As a result, the wiper did not interfere with the edge of the recording element substrate 1100, and thus the wiper was not chipped.

With the above-described embodiments, since the side of the protrusion is provided at a position facing the side surface of the recording element substrate so as to narrow the gap between the recording element substrate and the second plate, the amount of sealant to be injected can be reduced while the liquid level of the sealant is left unchanged. Accordingly, the amount of expansion or contraction of the sealant due to the temperature change can be reduced, a crack and the like of the recording element substrate can be prevented, and the interference between the wiper and the recording element substrate can be prevented.

In addition, since the protrusion is provided such that the distance between the side of the protrusion and the side surface of the recording element substrate becomes minimum at least at the center portion in the longitudinal direction of the recording element substrate, the pressure of the sealant applied to the fragile portion of the recording element substrate having the opening can be reduced. Further, since the large space is provided at the end portion in the longitudinal direction of the recording element substrate, the space being larger than the gap provided at the center portion thereof, the above advantages can be also provided, and the tip end of the needle for injecting the sealant can be inserted to the space.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-202328 filed Jul. 25, 2006, which is hereby incorporated by reference herein in its entirety.

What is claimed is:

1. An ink jet recording head comprising:

a recording element substrate having an array of discharge ports configured to discharge ink, an ink supply port penetrating the recording element substrate so as to supply ink to the discharge ports, and a side surface extending along an array direction of the discharge ports; and an opposite surface facing the side surface, wherein a minimum distance is provided between the opposite surface and the side surface at least at a center portion of the side surface, and a distance greater than the minimum distance is provided between the opposite surface and the side surface at an end portion of the side surface in the array direction.

2. The ink jet recording head according to claim 1, further comprising:

a first plate configured to support the recording element substrate; and a second plate supported by the first plate and having a side edge surrounding an outer periphery of the recording element substrate.

3. The ink jet recording head according to claim 2, wherein the opposite surface is the side edge.

4. The ink jet recording head according to claim 2, further comprising a protrusion provided between the side surface and the side edge, the protrusion having a side facing the side surface and defining at least a part of the opposite surface.

5. The ink jet recording head according to claim 4, wherein the opposite surface is the side of the protrusion and the side edge.

6. The ink jet recording head according to claim 2, wherein the recording element substrate includes another side surface extending along a direction different from the array direction, and another opposite surface facing the another side surface is provided between the side edge and the another side surface.

7. The ink jet recording head according to claim 4, wherein the opposite surface is the side of the protrusion.

8. The ink jet recording head according to claim 1, wherein a height of the opposite surface with respect to the first plate is smaller than a height of an upper surface of the recording element substrate with respect to the first plate.

9. The ink jet recording head according to claim 1, wherein a gap between the outer periphery of the recording element substrate and the opposite surface is expanded at a portion near a corner of the outer periphery of the recording element substrate.

* * * * *